US008217746B2

(12) United States Patent
Kitajima et al.

(10) Patent No.: US 8,217,746 B2
(45) Date of Patent: Jul. 10, 2012

(54) CHOKE COIL FOR INTERLEAVED PFC CIRCUIT

(75) Inventors: Nobuo Kitajima, Tokyo (JP); Satoshi Shinbo, Tokyo (JP)

(73) Assignee: TDK Corporation, Tokyo (JP)

( * ) Notice: Subject to any disclaimer, the term of this patent is extended or adjusted under 35 U.S.C. 154(b) by 146 days.

(21) Appl. No.: 12/764,335

(22) Filed: Apr. 21, 2010

(65) Prior Publication Data

US 2010/0271164 A1 Oct. 28, 2010

(30) Foreign Application Priority Data

Apr. 28, 2009 (JP) ..... 2009-110104

(51) Int. Cl.
*H01F 17/06* (2006.01)

(52) U.S. Cl. ..... 336/178

(58) Field of Classification Search ..... 336/68, 336/83, 178, 192, 198, 212, 232, 220–223, 336/65

See application file for complete search history.

(56) References Cited

U.S. PATENT DOCUMENTS

| | | | | |
|---|---|---|---|---|
| 6,366,034 | B1 * | 4/2002 | Kwon et al. | 315/368.25 |
| 2008/0224809 | A1 * | 9/2008 | Zhang et al. | 336/170 |

FOREIGN PATENT DOCUMENTS

| | | | |
|---|---|---|---|
| JP | 64-30463 | A | 2/1989 |
| JP | 09293616 | A | * 11/1997 |
| JP | 11-204355 | A | 7/1999 |
| JP | 2000-124047 | A | 4/2000 |
| JP | 2003308995 | A | * 10/2003 |
| JP | 2005-11889 | A | 1/2005 |
| JP | 2006-60108 | A | 3/2006 |
| JP | 2007-195282 | A | 8/2007 |

* cited by examiner

*Primary Examiner* — Tuyen Nguyen
(74) *Attorney, Agent, or Firm* — Leydig, Voit & Mayer, Ltd.

(57) ABSTRACT

A choke coil includes a pair of E-shaped cores, first and second coil windings around central legs of the E-shaped cores, and an I-shaped core. Side legs of the pair of E-shaped cores are positioned face to face with each other with the I-shaped core intervening. There are gaps between the I-shaped core and each central leg. Electrical currents flow in the first and second coil windings in the same direction, and magnetic fluxes generated by each of the electrical currents are in opposite directions in the I-shaped core.

7 Claims, 7 Drawing Sheets

CHOKE COIL FOR INTERLEAVED PFC CIRCUIT

BACKGROUND OF THE INVENTION

1. Field of the Invention

The present invention relates to a choke coil, which is used in an interleaved PFC (Power Factor Correction) circuit, which has two coil windings, and which can act as two virtually independent choke coils.

2. Description of the Related Art

In recent years, a PFC circuit has been set in a power supply of an electronic device. Especially in an application over 300W, an interleaved PFC circuit has been adopted in order to reduce ripple current and power loss. "Interleave" means connecting circuits in parallel, with their phases shifted from each other.

FIG. 13 shows an example of an interleaved PFC circuit. The interleaved PFC circuit is configured so that two circuits, one of which includes a choke coil $L_1$, a switching element $S_1$ and a diode $D_1$, and the other of which includes a choke coil $L_2$, a switching element $S_2$ and a diode $D_2$, are connected in parallel and are shifted in phase from each other. A capacitor $C_{OUT}$ for ripple riddance is connected in parallel with a load resistance $R_{LOAD}$ in an output side of the interleaved PFC circuit. Input voltage $V_{IN}$ is, for example, a full-wave rectified AC 100V from a commercial power supply.

FIGS. 14A to 14D are waveform charts at each point of the interleaved PFC circuit shown in FIG. 13. FIG. 14A shows a timing of on-off of the switching elements $S_1$, $S_2$. FIG. 14B shows electric currents $IL_1$, $IL_2$ flowing through the choke coils $L_1$, $L_2$ and an input electric current $I_{IN}$ (sum of the electric currents $IL_1$, $IL_2$). FIG. 14C shows electric currents $I_1$, $I_2$ flowing through the diodes $D_1$, $D_2$. FIG. 14D shows electric current $I_{COUT}$ (=($I_1$+$I_2$)−$I_{OUT}$ ($I_{OUT}$: output electric current)) flowing through the capacitor $C_{OUT}$.

As shown in FIG. 14D, in the interleaved PFC circuit, frequency of a ripple current is twice as high as switching frequency, so that the ripple current reduces effectually.

Generally, above mentioned interleaved PFC circuit needs two independent choke coils, but it costs high and requires large space for mounting. Therefore, a choke coil of 2 in 1 structure for interleave has been desired.

The first patent document, Japanese Patent Application Laid-Open No. 2006-60108 proposes a transformer of 2 in 1 structure. However, the transformer is not for a PFC circuit but a high-voltage transformer for lighting a backlight of a liquid crystal display device. In the transformer, two pairs of first and second windings are on one assembly of magnetic cores of E-I-E-shape so that the transformer can act as virtually two high-voltage transformers. In this structure, magnetic fluxes generated by the two pairs of first and second windings pass through an I-shaped core between end surfaces of a pair of E-shaped cores, and the magnetic fluxes are of the same direction in the I-shaped core so that the magnetic fluxes are added to each other in the I-shaped. Therefore, there is a problem that a sectional area of the I-shaped core needs to be large, namely, the I-shaped core needs to be thick, and a shape of the assembly of magnetic cores needs to be large.

As above mentioned, using two independent choke coils in an interleaved PFC circuit costs high and requires large space for mounting, and even by the 2 in 1 structure disclosed in the first patent document, a shape of the assembly of magnetic cores is not always sufficiently small.

SUMMARY OF THE INVENTION

The present invention has been made in view of the foregoing circumstances and problems, and an object thereof is to provide a choke coil for an interleaved PFC circuit, which is of 2 in 1 structure and acts as two virtually independent choke coils, and which is of low cost and is of small shape.

An embodiment of the present invention relates to a choke coil for an interleaved PFC circuit. The choke coil includes: first and second magnetic cores having a central leg, side legs in respective opposite sides of the central leg, and a connection part connecting the central leg and the side legs; a first coil winding around the central leg of the first magnetic core; a second coil winding around the central leg of the second magnetic core; and a third magnetic core of flat plate shape. In the choke coil, end surfaces of the side legs of the first and second magnetic cores face to face with each other through the third magnetic core, gaps are between the third magnetic core and each end surface of the central legs of the first and second magnetic cores respectively, electric currents flowing in the first and second coil windings respectively are of the same direction, and magnetic fluxes generated by the electric currents respectively and passing through the third magnetic core are of opposite direction.

The choke coil may include a bobbin including two winding frames and a link part integrally linking the two winding frames so that a core arrangement space is between the two winding frames. In the choke coil, the first coil winding may be on an outer circumference part of one of the two winding frames, the second coil winding may be on an outer circumference part of the other of the two winding frames, the central leg of the first magnetic core may be inside an inner circumference part of one of the two winding frames, the central leg of the second magnetic core may be inside an inner circumference part of the other of the two winding frames, and the third magnetic core may be in the core arrangement space.

And, in the choke coil, one or both of the two winding frames may include a terminal board. The choke coil may include terminals extending from the terminal board and to which winding ends of the first and second coil windings are connected.

In the choke coil, the first and second magnetic cores may be of the same shape and may be of the same size, and, a sectional area of the third magnetic core may be smaller than a sectional area of the central leg and may be equal to or larger than half of the sectional area of the central leg.

It is to be noted that any arbitrary combination of the above-described structural components as well as the expressions according to the present invention changed among a system and so forth are all effective as and encompassed by the present embodiments.

According to the embodiment described above, a shape of an assembly of first to third magnetic cores is downsized, and 2 in 1 structure acting as two virtually independent choke coils is achieved. Moreover, owing to above downsizing of the assembly, cost reduction can be done, size of a product can be small, and a mounting space can also be small.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, the drawings in which.

DETAILED DESCRIPTION OF THE INVENTION

Figure 1:
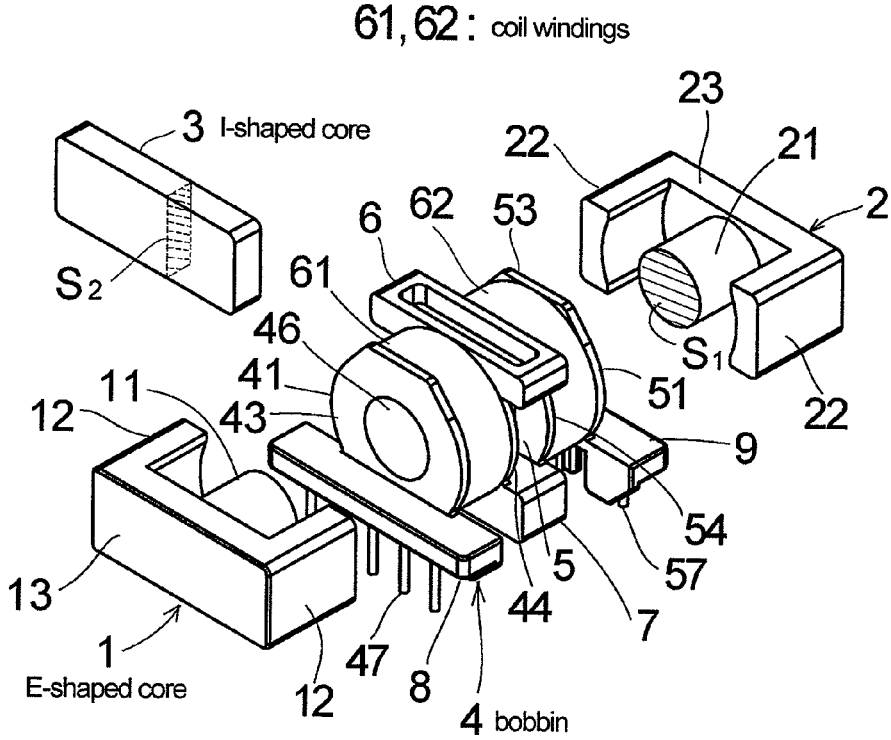
FIG. 1 is an exploded perspective view from a top side of the choke coil for an interleaved PFC circuit (PFC choke coil) according to an embodiment of the present invention.
Figure 2:
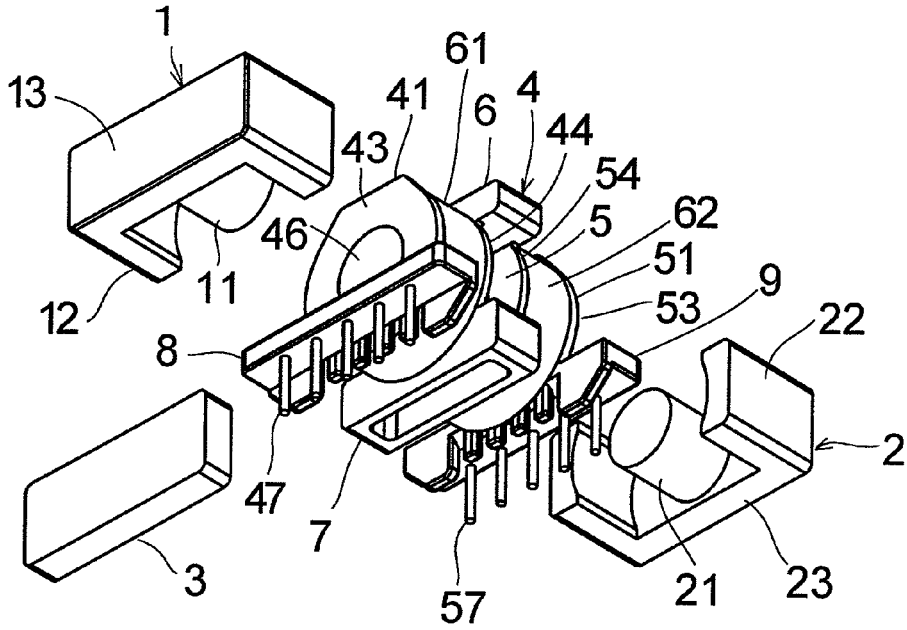
FIG. 2 is an exploded perspective view from a bottom side of the PFC choke coil.
Figure 3:
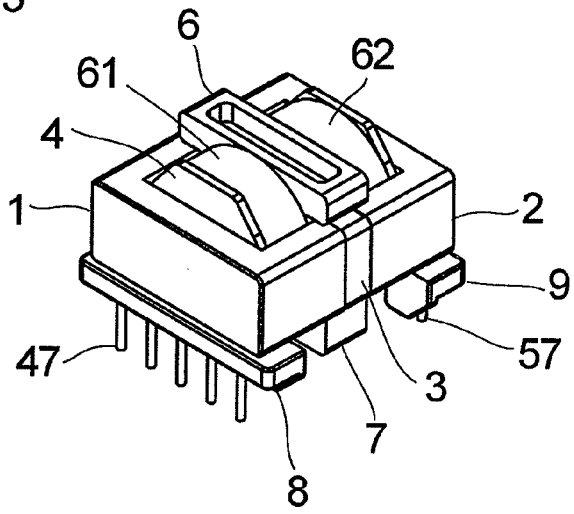
FIG. 3 is a perspective view from a top side of the PFC choke coil.
Figure 4:
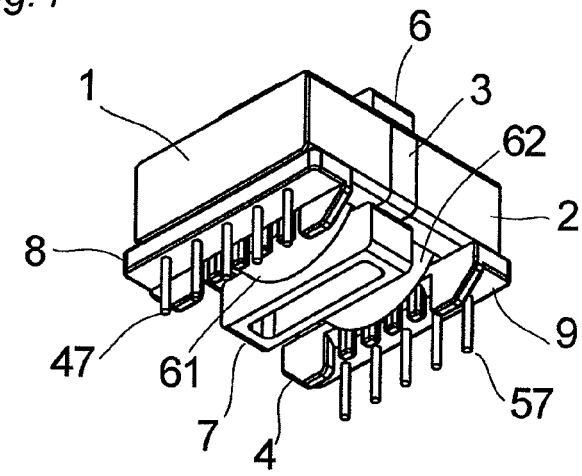
FIG. 4 is a perspective view from a bottom side of the PFC choke coil.
Figure 5:
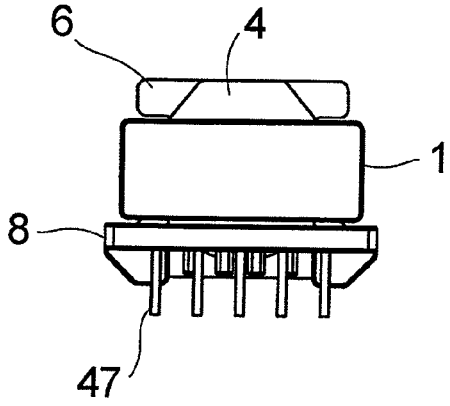
FIG. 5 is an elevation view of the PFC choke coil.
Figure 6:
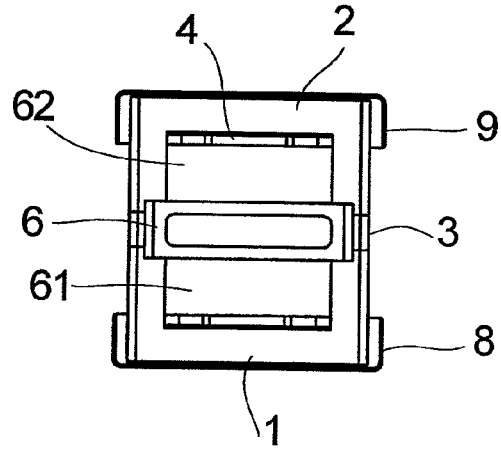
FIG. 6 is a top view of the PFC choke coil.
Figure 7:
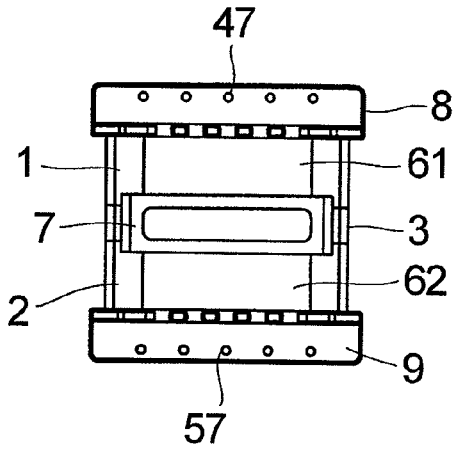
FIG. 7 is a bottom view of the PFC choke coil.
Figure 8:
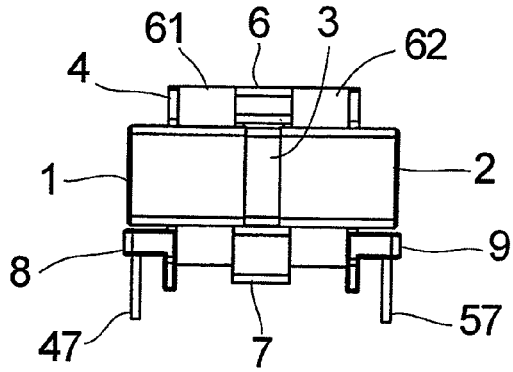
FIG. 8 is a side view of the PFC choke coil.

The invention will now be described based on the following embodiments which do not intend to limit the scope of the present invention but exemplify the invention. All of the features and the combinations thereof described in the embodiments are not necessarily essential to the invention.

As shown in FIGS. 1 to 8, a choke coil for an interleaved PFC circuit (PFC choke coil) includes E-shaped cores 1, 2 as first and second magnetic cores, an I-shaped core 3 as a third magnetic core, a bobbin 4 having two winding frames 41, 51, and first and second coil windings 61, 62 on the winding frames 41, 51.

A pair of the E-shaped cores 1, 2, for example ferrite cores, are of the same shape and are of the same size. The E-shaped core 1 includes a central leg 11, side legs 12 in respective opposite sides of the central leg 11, and a flat-plate-shaped connection part 13 connecting the central leg 11 and the side legs 12. Equally, the E-shaped core 2 includes a central leg 21, side legs 22, and a plate-shaped connection part 23.

The I-shaped core 3, for example a ferrite core, is a flat plate which is as wide as or wider than the side legs 12, 22 of the E-shaped cores 1, 2.

The bobbin 4 made of isolation resin includes two winding frames 41, 51 and two link parts 6, 7 integrally linking the two winding frames 41, 51 so that a core arrangement space 5 into which the I-shaped core 3 is inserted is between the two winding frames 41, 51. The winding frames 41, 51 are of the same shape, are of the same size, and are arranged symmetrically. The winding frame 41 includes cylindrical winding drum and flanges 43, 44 on respective opposite sides of the cylindrical winding drum. Equally, the winding frame 51 includes cylindrical winding drum and flanges 53, 54 on respective opposite sides of the cylindrical winding drum. The link parts 6, 7 link the flanges 44, 54, whose end surfaces are parts of inner walls of the core arrangement space 5. Inner flat surfaces of the link parts 6, 7 are the other parts of the inner walls of the core arrangement space 5. The I-shaped core 3 is positioned and held by the inner walls and is not shaky. Terminal boards 8, 9 are on the flanges 43, 53 sitting outside, respectively. Terminal pins 47, 57 are extending from the terminal boards 8, 9, respectively.

A first coil winding 61 is on an outer circumference of the winding frame 41, namely is on the cylindrical winding drum between the flanges 43, 44. A second coil winding 62 is on an outer circumference of the winding frame 51, namely is on the cylindrical winding drum between the flanges 53, 54. Winding ends of the first coil winding 61 are connected to predetermined terminal pins 47. Winding ends of the second coil winding 62 are connected to predetermined terminal pins 57.

The central leg 11 of the E-shaped core 1 is inserted into an inner circumference part 46 (inner through-hole) of the winding frame 41. The central leg 21 of the E-shaped core 2 is inserted into an inner circumference part (inner through-hole) of the winding frame 51. The I-shaped core 3 is in the core arrangement space 5.

Figure 9:
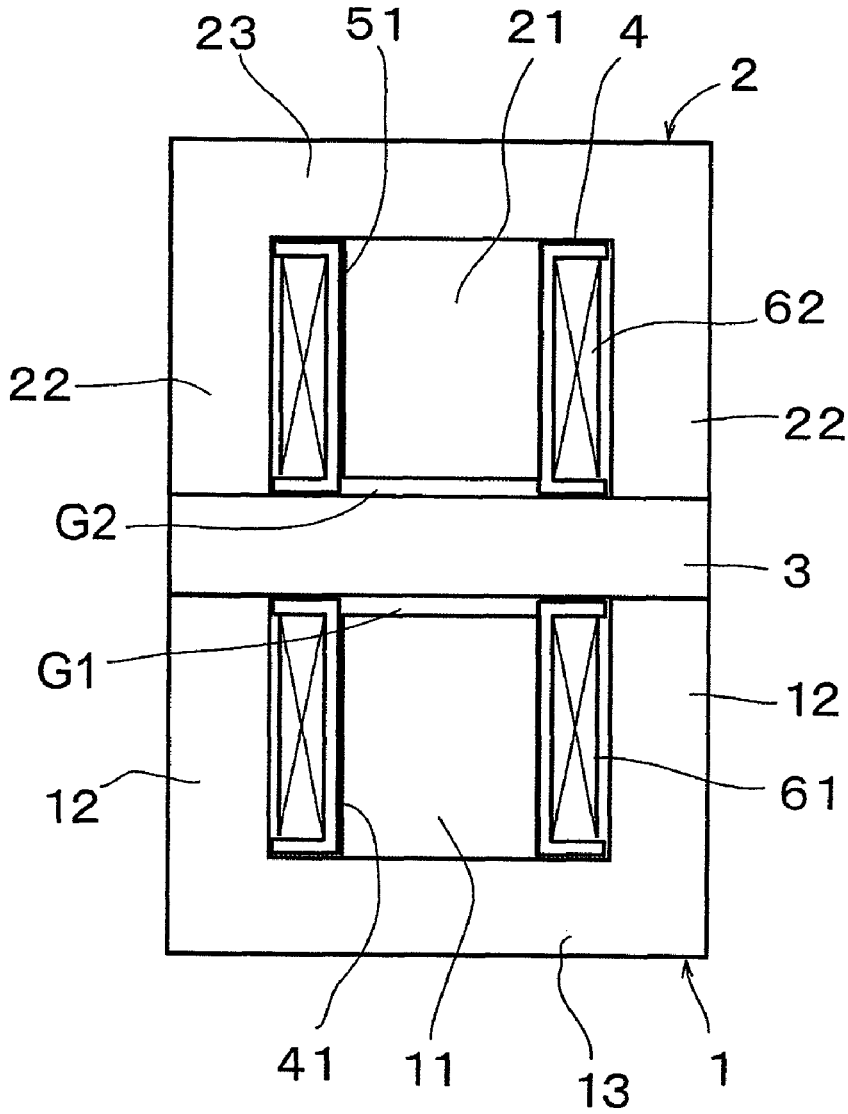
FIG. 9 is a sectional view of a substantial part of the PFC choke coil.

As shown in FIG. 9, when the E-shaped cores 1, 2 and the I-shaped core 3 are set on the bobbin 4 to which the first and second coil windings 61, 62 are given, the side legs 12, 22 of the E-shaped cores 1, 2 are face-to-face with each other, and the I-shaped core 3 is between the E-shaped cores. That is, the side legs 12 touch and are joined to one surface of the I-shaped core 3, and the side legs 22 touch and are joined to the opposite surface of the I-shaped core 3. Gaps Gl, G2 are between the I-shaped core 3 and the central legs 11, 21.

An adhesive material, an adhesion tape, squeezing metal parts, or the like are used when uniting the E-shaped cores 1, 2 and the I-shaped core 3.

Figure 10A:
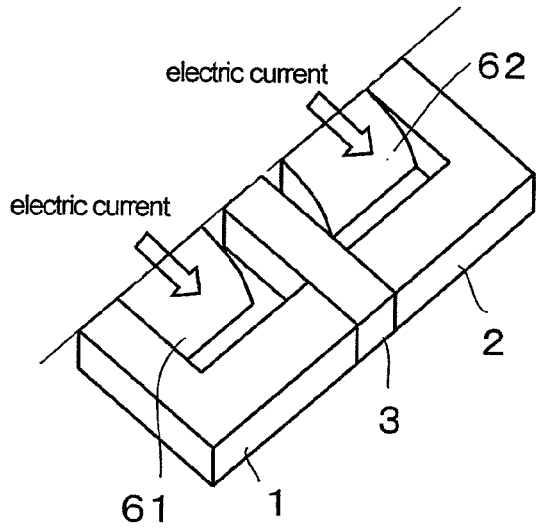
FIG. 10A shows flows of electric currents in the PFC choke coil.
Figure 10B:
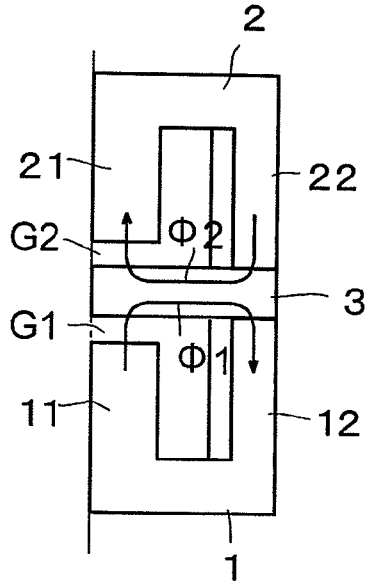
FIG. 10B shows flows of magnetic fluxes in the PFC choke coil.

As shown in FIG. 10A, electric currents flowing in the first and second coil windings 61, 62 are of the same direction. Therefore, as shown in FIG. 10B, a magnetic flux $\Phi 1$ generated by the first coil winding 61 and a magnetic flux $\Phi 2$ generated by the second coil winding 62 are of opposite direction and cancel each other when passing through the I-shaped core 3 separating coils, so magnetic fluxes do not concentrate too much in the I-shaped core 3. Note that magnetic fluxes rarely round wide, passing both of the central legs 11, 12 of the E-shaped cores 1, 2, because of the gaps G1, G2 between the I-shaped core 3 and the central legs 11, 21.

Figure 11A:
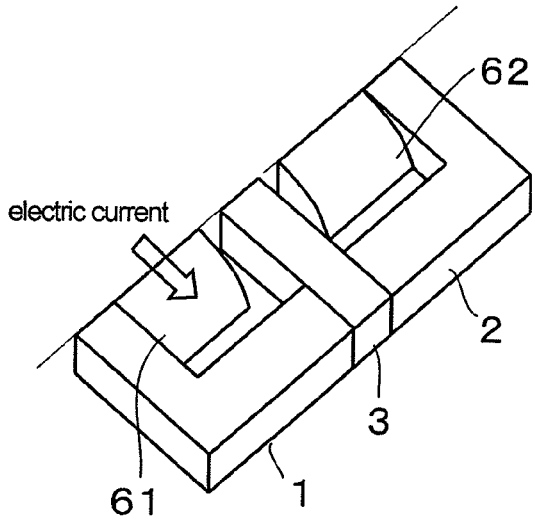
FIG. 11A shows flow of an electric current when an electric current flows in only one of the first and second coil windings.
Figure 11B:
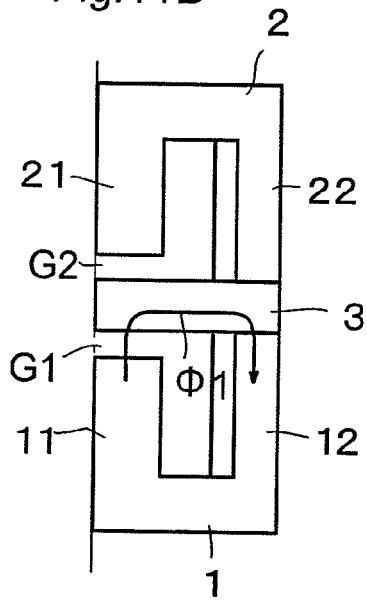
FIG. 11B shows flow of a magnetic flux in the case of FIG. 11A.
Figure 12A:
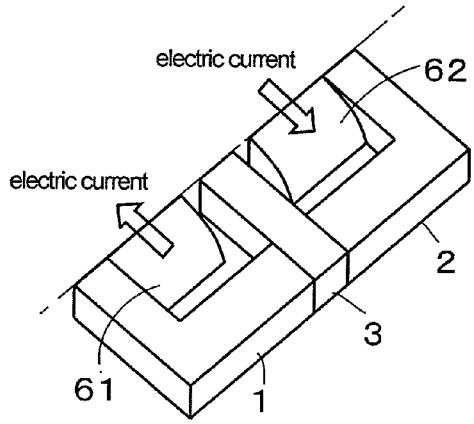
FIG. 12A shows flows of electric currents in the case where the electric currents are of opposite direction unlike the embodiment.
Figure 12B:
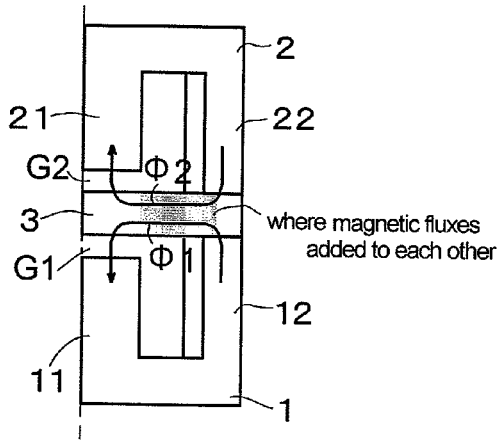
FIG. 12B shows flows of magnetic fluxes in the case of FIG. 12A.
Figure 13:
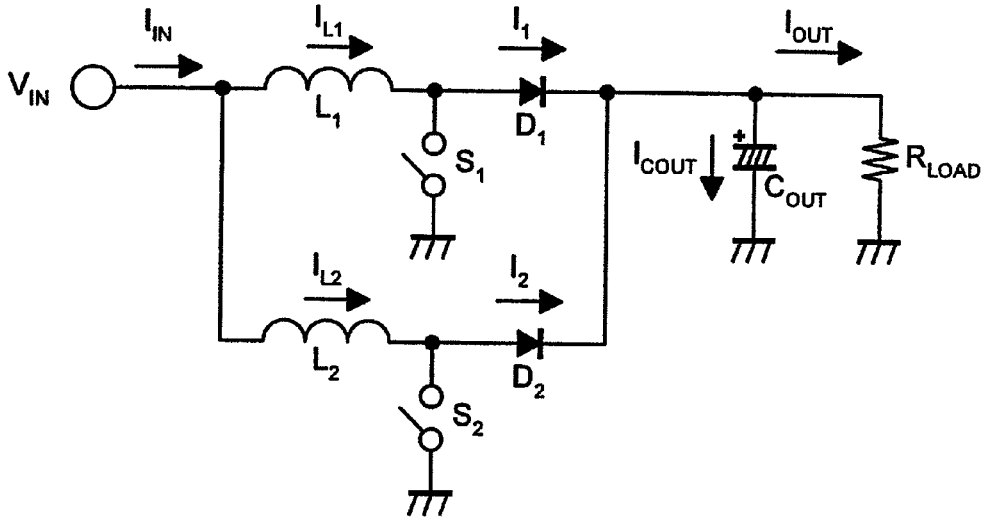
FIG. 13 shows an example of an interleaved PFC circuit.
Figure 14A:
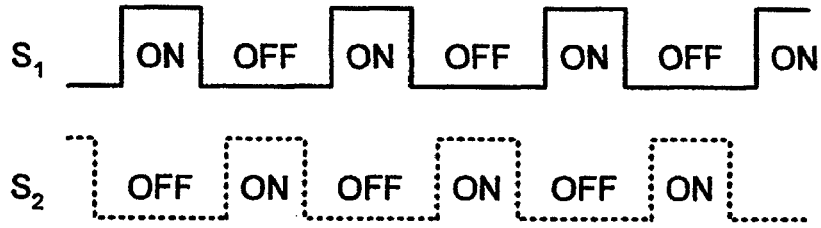
FIGS. 14A to 14D are waveform charts at each point of the interleaved PFC circuit shown in FIG. 13.
Figure 14B:
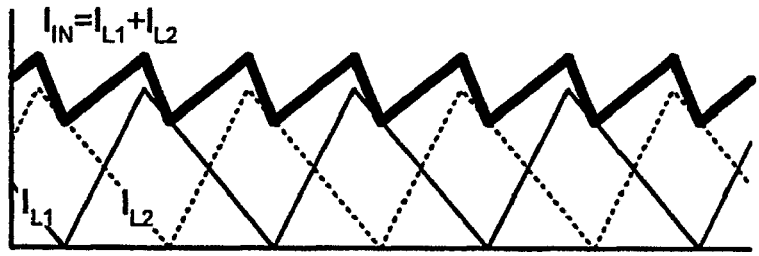
Figure 14C:
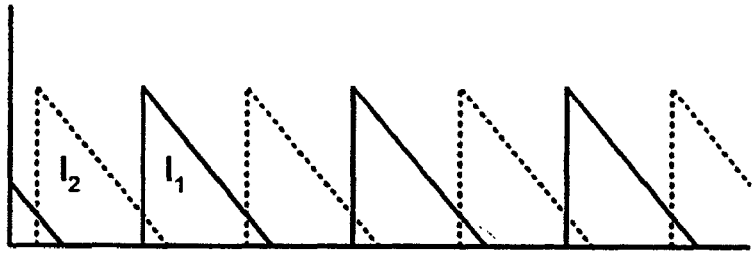
Figure 14D:
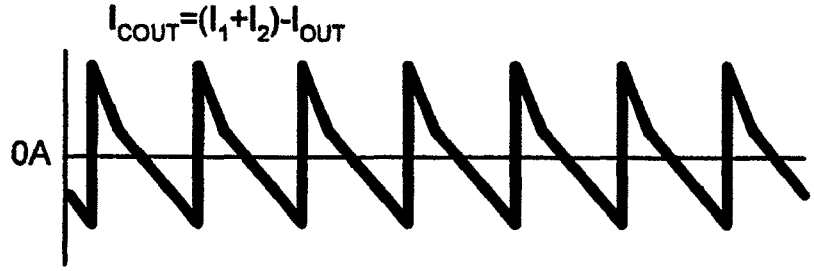

In the embodiment, the most severe condition of use is that an electric current flows in only one of the first and second coil windings 61, 62 as shown in FIG. 11A. Even in such condition, as long as a sectional area $S_2$ (see FIG. 1) of the I-shaped core 3 separating coils is equal to or larger than half of a sectional area $S_1$ (see FIG. 1) of the central legs of the E-shaped cores 1, 2, the sectional area $S_2$ is large enough, because a magnetic flux passes through the central leg and divides into two ways (left and right) in the middle of the I-shaped core 3.

As a result, the first coil winding 61 and core-part around it constitute a first choke coil part, the second coil winding 62 and core-part around it constitute a second choke coil part, and the first and second choke coil parts little combine with each other, so that the first and second choke coil parts can act as two virtually independent choke coils.

Note that if electric currents flowing in the first and second coil windings 61, 62 are of opposite direction like the transformer of 2 in 1 structure disclosed in the first patent document, the I-shaped core 3, a common flux path, is strongly excited. Therefore, magnetic permeability of the I-shaped core 3 lowers so that the I-shaped core 3 becomes a virtual gap, and an inductance as a choke coil lowers. In order to correct such demerits, a sectional area of the I-shaped core 3 needs to be set larger than the sectional area of the central legs of the E-shaped cores 1, 2. Therefore, a shape of an assembly of the E-shaped cores 1, 2 and the I-shaped core 3 can not be small.

On the other hand, in the embodiment, magnetic fluxes Φ1, Φ2 cancel each other in the I-shaped core 3, a common flux path, as shown in FIG. 10A. Therefore, it is clear that the sectional area of the I-shaped core 3 may be smaller than the sectional area of the central legs of the E-shaped cores 1, 2. From the point of view of downsizing, a relation between the sectional area $S_1$ (see FIG. 1) of the central legs of the E-shaped cores 1, 2 and the sectional area $S_2$ (see FIG. 1) of the I-shaped core 3 is optimally $$S_2=S_1/2.$$

As long as the relation is $$S_1>S_2>S_1/2,$$

downsizing can be achieved compared to the related art, the first patent document.

As a result of the embodiment of the present invention, the following effects can be obtained.

(1) Downsizing a shape of an assembly of the E-shaped cores 1, 2 and the I-shaped core 3, 2 in 1 structure acting as two virtually independent choke coils is achieved.

(2) Owing to above downsizing of the assembly, cost reduction can be done, size of a product can be small, and a mounting space can also be small.

(3) As the bobbin 4 includes the two winding frames 41, 51 and the two link parts 6, 7 integrally linking the two winding frames 41, 51 so that the core arrangement space 5 is between the two winding frames 41, 51, winding on both winding frames 41, 51 can be done by same one process, whose workability is good. Moreover, by using the bobbin 4, positioning of the E-shaped cores 1, 2 and the I-shaped core 3 becomes easy and a workability of an assembly is good.

Described above is an explanation based on the embodiment. The description of the embodiments is illustrative in nature and various variations in constituting elements and processes involved are possible. Those skilled in the art would readily appreciate that such variations are also within the scope of the present invention.

Instead of the E-shaped cores in the embodiment, a pair of PQ cores, which include a central leg and side legs in respective opposite sides of the central leg and in which the side legs are wider than the central leg, a pair of pot cores, in which the side leg surrounds the central leg, or the like are available.

While, in the embodiment, a terminal board are on both flanges sitting outside, and an axial direction of a central leg of a core is parallel to a mounting surface, a pair of terminal boards may be on only one of the flanges sitting outside, and an axial direction of a central leg of a core may be vertical to a mounting surface.

What is claimed is:

1. A choke coil for an interleaved power factor control (PFC) circuit, comprising:

first and second magnetic cores, each core having a central leg, side legs on respective opposite sides of the central leg, and a connection part connecting the central leg to the side legs;

a first coil winding around the central leg of the first magnetic core;

a second coil winding around the central leg of the second magnetic core; and a third magnetic core having a flat plate shape, wherein end surfaces of the side legs of the first and second magnetic cores are face-to-face with each other, with the third magnetic core between the end surfaces, gaps are present between the third magnetic core and end surfaces of each of the central legs of the first and second magnetic cores, respectively, respective electrical currents flow in the first and second coil windings in the same direction, and magnetic fluxes generated by the respective electrical currents and passing through the third magnetic core are in opposite directions.

2. The choke coil according to claim 1, comprising a bobbin including first and second winding frames and a link part integrally linking the first and second winding frames and defining a core arrangement space between the first and second winding frames, wherein the first coil winding is on an outer circumference part of the first winding frame, the second coil winding is on an outer circumference part of the second winding frame, the central leg of the first magnetic core is inside an inner circumference part of the first winding frame, the central leg of the second magnetic core is inside an inner circumference part of the second winding frame, and the third magnetic core is in the core arrangement space.

3. The choke coil according to claim 2, wherein at least one of the first and second winding frames includes a terminal board, and further comprising terminals extending from the terminal board and to which winding ends of the first and second coil windings are connected.

4. The choke coil according to claim 1, wherein the first and second magnetic cores have the same shape and the same size, and cross-sectional area of the third magnetic core is smaller than cross-sectional area of the central leg and is at least equal in size to one half of the cross-sectional area of the central leg.

5. A choke coil assembly for an interleaved power factor control (PFC) circuit, the choke coil comprising:

first and second magnetic cores, each of the first and second magnetic cores having a central leg, two side legs located on respective opposite sides of and spaced from the central leg, and a connection part joining the central leg to the side legs, each of the central leg and the side legs having respective end surfaces transverse to the side legs and the central leg, and the end surfaces having respective areas;

a first coil winding surrounding the central leg of the first magnetic core;

a second coil winding surround the central leg of the second magnetic core; and a third magnetic core having a flat plate shape, the third magnetic core having a thickness extending between opposed side surfaces of the third magnetic core, wherein the end surfaces of the side legs of the first and second magnetic cores are face-to-face, the third magnetic core is located between the end surfaces of the side legs of the first and second magnetic cores, with the end surfaces of the side legs of the first and second magnetic cores in contact with the side surfaces of the third magnetic core, the third magnetic core has a cross sectional area in a thickness direction of the third magnetic core and transverse to the end surfaces of the side legs of the first and second magnetic cores, the central legs of the first and second magnetic cores are separated from respective side surfaces of the third magnetic core by respective gaps, the cross sectional area of the third magnetic core is smaller than the areas of the end surfaces of the central legs of the first and second magnetic cores, and the cross sectional area of the third magnetic core is at least equal in area to one-half of the area of the end surfaces of each of the central legs of the first and second magnetic cores.

6. The choke coil assembly according to claim 5, comprising a bobbin, wherein the bobbin includes first and second winding frames, and a link part integrally linking the first winding frame to the second winding frame and defining a core arrangement space located between the first and second winding frames, the first coil winding is located on an outer circumference part of the first winding frame, the second coil winding is located on an outer circumference part of the second winding frame, the central leg of the first magnetic core is located inside an inner circumference part of the first winding frame, the central leg of the second magnetic core is located inside an inner circumference part of the second winding frame, and the third magnetic core is located in the core arrangement space.

7. The choke coil assembly according to claim 6, wherein at least one of the first and second winding frames includes a terminal board, and the terminal board includes terminals extending from the terminal board and to which winding ends of the first and second coil windings are connected.

* * * * *